US012123095B2

(12) United States Patent
Kikuchi et al.

(10) Patent No.: US 12,123,095 B2
(45) Date of Patent: Oct. 22, 2024

(54) HOT-DIP GALVANIZED STEEL SHEET

(71) Applicant: NIPPON STEEL CORPORATION, Tokyo (JP)

(72) Inventors: Shota Kikuchi, Tokyo (JP); Masafumi Azuma, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 18/024,938

(22) PCT Filed: Jul. 20, 2021

(86) PCT No.: PCT/JP2021/027172
§ 371 (c)(1),
(2) Date: Mar. 6, 2023

(87) PCT Pub. No.: WO2022/079970
PCT Pub. Date: Apr. 21, 2022

(65) Prior Publication Data

US 2023/0313356 A1 Oct. 5, 2023

(30) Foreign Application Priority Data

Oct. 12, 2020 (JP) ..... 2020-171776

(51) Int. Cl.

| | |
|---|---|
| ***C23C 2/40*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |

(Continued)

(52) U.S. Cl.
CPC ..... *C23C 2/40* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/14* (2013.01); *C23C 2/02* (2013.01);
(Continued)

(58) Field of Classification Search
None
See application file for complete search history.

(56) References Cited

U.S. PATENT DOCUMENTS 10,526,671 B2 * 1/2020 Hata ..... C22C 38/02
2015/0024234 A1 1/2015 Yamano et al.
(Continued)

FOREIGN PATENT DOCUMENTS

CN 110959048 A 4/2020
WO WO2013/147228 A1 10/2013

*Primary Examiner* — Daniel J. Schleis
(74) *Attorney, Agent, or Firm* — Birch, Stewart, Kolasch & Birch, LLP

(57) ABSTRACT

This hot-dip galvanized steel sheet includes: a steel sheet; a boundary layer provided on the steel sheet; and a hot-dip galvanized layer provided on the boundary layer, in which the steel sheet has a predetermined chemical composition, in a region between a surface of the steel sheet and a depth of 25 μm from the surface of the steel sheet, an average grain size exceeds 4.0 μm, in a region between a position of 50 μm from the surface of the steel sheet and a position of 100 μm from the surface of the steel sheet, an area ratio of unrecrystallized ferrite is 50% or more, and in the hot-dip galvanized layer, a maximum value of a C concentration is 0.05 mass % or more.

4 Claims, 1 Drawing Sheet

(51) Int. Cl.

| | |
|---|---|
| ***C22C 38/06*** | (2006.01) |
| ***C22C 38/14*** | (2006.01) |
| ***C23C 2/02*** | (2006.01) |
| ***C23C 2/06*** | (2006.01) |

(52) U.S. Cl.
CPC ..... *C23C 2/024* (2022.08); *C23C 2/06* (2013.01); *C21D 2211/005* (2013.01)

(56) References Cited

U.S. PATENT DOCUMENTS

| | | | |
|---|---|---|---|
| 2017/0327919 | A1 | 11/2017 | Kawasaki et al. |
| 2020/0156349 | A1 | 5/2020 | Morishita et al. |

* cited by examiner

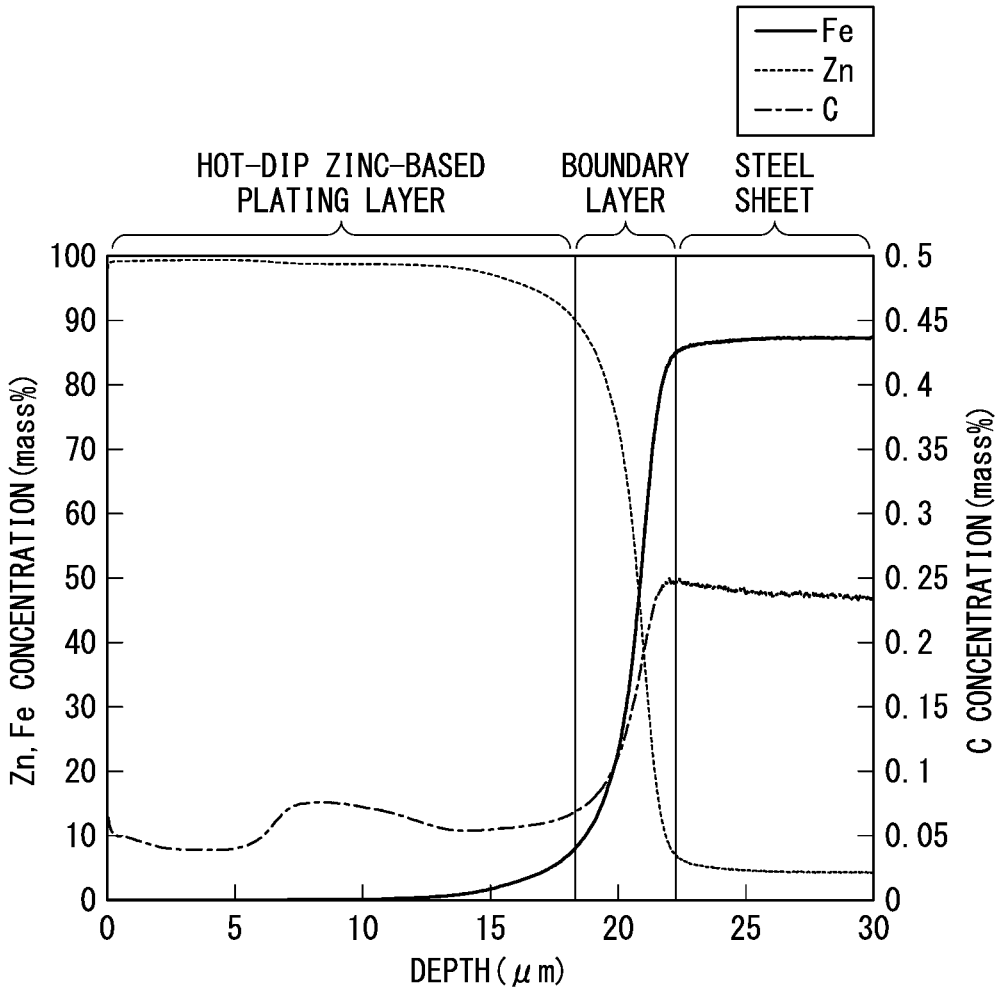
Fe
Zn
C
HOT-DIP ZINC-BASED PLATING LAYER
BOUNDARY LAYER
STEEL SHEET
Zn, Fe CONCENTRATION (mass%)
C CONCENTRATION (mass%)
DEPTH (μm)
0
5
10
15
20
25
30
0
10
20
30
40
50
60
70
80
90
100
0
0.05
0.1
0.15
0.2
0.25
0.3
0.35
0.4
0.45
0.5

HOT-DIP GALVANIZED STEEL SHEET

TECHNICAL FIELD OF THE INVENTION

The present invention relates to a hot-dip galvanized steel sheet.

Priority is claimed on Japanese Patent Application No. 2020-171776, filed Oct. 12, 2020, the content of which is incorporated herein by reference.

BACKGROUND ART

In recent years, a need for high-strengthening of vehicle members has increased from viewpoints of stricter collision safety criteria for vehicles and an improvement in fuel efficiency. The application of hot stamping has been extended in order to achieve the high-strengthening of vehicle members. Hot stamping is a technique for pressing a blank that is heated to a temperature ($Ac_3$ point), at which an austenite single phase region is formed, or higher (for example, heated to about 900° C.) and then rapidly cooling the blank in a die at the same time as forming to perform quenching. According to this technique, it is possible to manufacture a press-formed product having high shape fixability and high strength.

Since a Zn component remains on a surface layer of a formed product obtained after hot stamping in a case where hot stamping is applied to a zinc-based plated steel sheet, an effect of improving corrosion resistance can be obtained compared to a formed product obtained from hot stamping of an unplated steel sheet. For this reason, the application of hot stamping to a zinc-based plated steel sheet is being extended.

Patent Document 1 discloses a hot press-formed steel member manufactured by a method including a heating step of heating a galvanized steel sheet to a temperature equal to or higher than an $Ac_3$ transformation point and a hot press forming step of performing hot press forming at least twice after the heating step, in which any hot press forming performed in the hot press forming step is performed to satisfy a predetermined expression ($R/t>\sqrt{a}\cdot(T-b)$).

In a case where the zinc-based plated steel sheet is subjected to hot stamping, electrode sticking (a phenomenon in which a copper electrode and plating provided on a surface of a formed product are melted and adhered to each other) may occur during spot welding in a formed product obtained after hot stamping. When electrode sticking occurs during spot welding, a poor weld occurs or it is necessary to stop a manufacturing line to replace the copper electrode, which is not preferable. Electrode sticking during spot welding is not considered in Patent Document 1.

PRIOR ART DOCUMENT

Patent Document

[Patent Document 1] PCT International Publication No. WO2013/147228

DISCLOSURE OF THE INVENTION

Problems to be Solved by the Invention

The present invention has been made in view of the above circumstances. An object of the present invention is to provide a hot-dip galvanized steel sheet from which a hot-stamp formed body excellent in spot weldability can be obtained. In addition, another object of the present invention is to provide a hot-dip galvanized steel sheet from which a hot-stamp formed body having the above-mentioned property and having strength generally required for a hot-stamp formed body can be obtained.

Means for Solving the Problem

The present inventors investigated causes of electrode sticking during spot welding. As a result, the present inventors found that electrode sticking during spot welding is greatly affected by voids (vacancy) present in a galvanized layer (a hot-dip galvanized layer obtained after hot stamping) of a hot-stamp formed body, so that electrode sticking during spot welding is further suppressed as the number of voids present in the galvanized layer decreases. The present inventors thought that an electric current path is locally narrowed due to the presence of voids in the galvanized layer, an overcurrent flows through the electric current path, and overheating occurs, which makes electrode sticking be likely to occur between an electrode and the galvanized layer.

In addition, although a detailed mechanism is uncertain, the present inventors thought that voids formed in the galvanized layer of the hot-stamp formed body are caused by a difference in thermal contraction between a steel sheet and the hot-dip galvanized layer during hot stamping forming. Therefore, the present inventors investigated a method for reducing the difference in thermal contraction between the steel sheet and the hot-dip galvanized layer during hot stamping. As a result, the present inventors found that in a hot-dip galvanized steel sheet, by setting an average grain size in a region (hereinafter, sometimes referred to as a surface layer region) between a surface of a steel sheet and a depth of 25 μm from the surface of the steel sheet to more than 4.0 μm, setting an area ratio of unrecrystallized ferrite in a region between a depth of 50 μm from the surface of the steel sheet and a depth of 100 μm from the surface of the steel sheet to 50% or more, setting a maximum value of a C concentration in a hot-dip galvanized layer to 0.05 mass % or more, the occurrence of voids in a galvanized layer of a hot-stamp formed body can be suppressed.

The present inventors presume that a mechanism by which the formation of voids in the galvanized layer of the hot-stamp formed body obtained from the hot-dip galvanized steel sheet is suppressed by using the hot-dip galvanized steel sheet is as follows. By setting the average grain size of the surface layer region of the steel sheet to more than 4.0 μm to coarsen grains, Fe—Zn alloying at a boundary layer between the steel sheet and the hot-dip galvanized layer can progress rapidly and homogeneously, and the number of grain boundaries, which tend to serve as starting points of an alloying reaction, is reduced. Therefore, unevenness of an Fe—Zn solid solution in the boundary layer is reduced. Furthermore, it is thought that in an initial stage of heating during hot stamping, due to the presence of unrecrystallized ferrite in the region between a depth of 50 μm from the surface of the steel sheet and a depth of 100 μm from the surface of the steel sheet, C that diffuses from the steel sheet into the grain boundaries of the boundary layer and C that is present in the hot-dip galvanized layer relieve a difference in alloying reaction rate between the grain boundaries of the boundary layer and the other regions and contribute to a reduction in the unevenness of the Fe—Zn solid solution. Accordingly, the difference in thermal contraction between the steel sheet and the hot-dip galvanized layer during heating in hot stamping can be reduced. As a result, it is presumed that the occurrence of voids in the galvanized layer of the hot-stamp formed body is suppressed.

The present inventors found that in order to obtain the hot-dip galvanized steel sheet as described above, it is effective to perform holding in a predetermined temperature range after hot rolling and coiling.

The gist of the present invention made on the basis of the above-mentioned findings is as follows.

[1] A hot-dip galvanized steel sheet according to an aspect of the present invention includes: a steel sheet, a boundary layer provided on the steel sheet; and a hot-dip galvanized layer provided on the boundary layer, in which the steel sheet contains, as a chemical composition, by mass %, C: 0.18% to 0.50%, Si: 0.10% to 1.50%, Mn: 0.50% to 2.50%, Al: 0.001% to 0.100%, Ti: 0.010% to 0.100%, S: 0.0100% or less, P: 0.100% or less, N: 0.0100% or less Nb: 0% to 0.05%, V: 0% to 0.50%, Cr: 0% to 0.50%, Mo: 0% to 0.50%, B: 0% to 0.0100%

Ni: 0% to 2.00%, and a sum of REM, Ca, Co, and Mg: 0% to 0.0300%, and a remainder comprising Fe and impurities, in a region between a surface of the steel sheet and a depth of 25 μm from the surface of the steel sheet, an average grain size exceeds 4.0 μm, in a region between a depth of 50 μm from the surface of the steel sheet and a depth of 100 μm from the surface of the steel sheet, an area ratio of unrecrystallized ferrite is 50% or more, and in the hot-dip galvanized layer, a maximum value of a C concentration is 0.05 mass % or more.

[2] In the hot-dip galvanized steel sheet according to [1], the steel sheet may contain, as the chemical composition, by mass %, one or two or more selected from the group comprising Nb: 0.02% to 0.05%, V: 0.005% to 0.50%, Cr: 0.10% to 0.50%, Mo: 0.005% to 0.50%, B: 0.0001% to 0.0100%, Ni: 0.01% to 2.00%, and a sum of REM, Ca, Co, and Mg: 0.0003% to 0.0300%.

[3] In the hot-dip galvanized steel sheet according to [1] or [2], the steel sheet may contain, as the chemical composition, by mass %, C: 0.25% to 0.50%.

Effects of the Invention

According to the aspect of the present invention, it is possible to provide a hot-dip galvanized steel sheet from which a hot-stamp formed body having excellent spot weldability and having strength generally required for a hot-stamp formed body can be obtained.

BRIEF DESCRIPTION OF THE DRAWINGS

FIG. 1 is a schematic diagram showing a GDS profile of a hot-dip galvanized steel sheet according to an embodiment.

EMBODIMENTS OF THE INVENTION

A hot-dip galvanized steel sheet according to an embodiment will be described in detail below. The hot-dip galvanized steel sheet according to the present embodiment includes a steel sheet, a boundary layer provided on the steel sheet, and a hot-dip galvanized layer provided on the boundary layer.

First, the steel sheet included in the hot-dip galvanized steel sheet according to the present embodiment will be described. The reason why a chemical composition of the steel sheet included in the hot-dip galvanized steel sheet according to the present embodiment is to be limited will be described below. Numerical values indicated as "more than or equal to" or "less than or equal to" fall within the numerical range. Numerical values indicated as "less than" or "more than" do not fall within the numerical range. All percentages (%) related to the chemical composition mean mass %.

The steel sheet included in the hot-dip galvanized steel sheet according to the present embodiment includes, as the chemical composition, by mass %, C: 0.18% to 0.50%, Si: 0.10% to 1.50%, Mn: 0.50% to 2.50%, Al: 0.001% to 0.100%, Ti: 0.010% to 0.100%, S: 0.0100% or less, P: 0.100% or less, N: 0.0100% or less, and a remainder comprising Fe and impurities. Each element will be described below.

C: 0.18% to 0.50%

C increases strength of a hot-stamp formed body obtained after hot stamping. When a C content is excessively low, the above-mentioned effect is not obtained. For this reason, the C content is set to 0.18% or more. The C content is preferably 0.20% or more, more than 0.20%, or 0.25% or more.

On the other hand, when the C content is excessively high, toughness of the hot-dip galvanized steel sheet decreases. Therefore, the C content is set to 0.50% or less. The C content is preferably 0.45% or less or 0.40% or less.

Si: 0.10% to 1.50%

Si is an element that improves a fatigue property of the hot-stamp formed body. In addition, Si is also an element that improves a hot-dip galvanizing property, particularly plating wettability, by forming a stable oxide film on a surface of the steel sheet during recrystallization annealing in a continuous hot-dip galvanizing line. In order to obtain these effects, a Si content is set to 0.10% or more. The Si content is preferably more than 0.14%, 0.15% or more, 0.18% or more, or 0.20% or more.

On the other hand, when the Si content is excessively high, Si contained in steel is diffused during heating at the time of hot stamping and forms an oxide on the surface of the steel sheet. The oxide formed on the surface of the steel sheet lowers a phosphate treatment property. In addition, Si is also an element that raises an $Ac_3$ point of the hot-dip galvanized steel sheet. When the $Ac_3$ point of the hot-dip galvanized steel sheet is raised, it is necessary to raise a heating temperature during hot stamping in order to achieve sufficient austenitizing. As a result, there are cases where the heating temperature during hot stamping exceeds an evaporation temperature of the hot-dip galvanized layer. For this reason, the Si content is set to 1.50% or less. The Si content is preferably 1.40% or less, 1.20% or less, or 1.00% or less.

Mn: 0.50% to 2.50%

Mn is an element that improves hardenability of steel. A Mn content is set to 0.50% or more to improve hardenability and obtain the desired strength of the hot-stamp formed body. The Mn content is preferably 1.00% or more, 1.50% or more, more than 1.50%, or 1.60% or more.

On the other hand, even though the Mn content exceeds 2.50%, an effect of improving hardenability is saturated and steel is embrittled, so that quenching cracks are likely to occur during casting, hot rolling, and cold rolling. For this reason, the Mn content is set to 2.50% or less. The Mn content is preferably 2.30% or less, 2.10% or less, or 2.00% or less.

Al: 0.001% to 0.100%

Al is an element that deoxidizes molten steel to suppress the formation of oxide serving as a fracture origin. Al is also an element that has an effect of improving corrosion resistance of the hot-stamp formed body. In order to obtain these effects, an Al content is set to 0.001% or more. The Al content is preferably 0.005% or more.

On the other hand, when the Al content is excessive, the $Ac_3$ point of the steel sheet rises, and it is necessary to raise the heating temperature for sufficient austenitizing. As a result, the heating temperature during hot stamping exceeds the evaporation temperature of the hot-dip galvanized layer. Therefore, the Al content is set to 0.100% or less. The Al content is preferably 0.090% or less, 0.070% or less, or 0.050% or less.

Ti: 0.010% to 0.100%

Ti is an element that increases oxidation resistance after hot-dip galvanizing. In addition, Ti is also an element that is bonded to N in steel to form nitride (TiN) and thus suppresses the formation of nitride (BN) of B, thereby improving hardenability of the steel sheet. In order to obtain these effects, a Ti content is set to 0.010% or more. The Ti content is preferably 0.020% or more.

On the other hand, when the Ti content is excessive, the $Ac_3$ point rises and the heating temperature during hot stamping becomes high, which may lower productivity. In addition, when the Ti content is excessive, a large amount of Ti carbide is formed and the amount of solute C is reduced, so that the strength of the hot-stamp formed body is reduced. Furthermore, there are cases where wettability of plating decreases, and toughness of the hot-stamp formed body deteriorates due to the excessive precipitation of Ti carbide. For this reason, a Ti content is set to 0.100% or less. The Ti content is preferably 0.070% or less.

S: 0.0100% or Less

S is an element that is contained in steel as an impurity and is an element that forms sulfide in steel to cause the deterioration of the toughness of the hot-stamp formed body and to lower a delayed fracture resistance property. For this reason, the S content is set to 0.0100% or less. The S content is preferably 0.0050% or less.

It is preferable that the S content is 0%. However, since a desulfurization cost is increased when the S content is to be excessively reduced, the S content may be set to 0.0001% or more.

P: 0.100% or Less

P is an element that is included in steel as an impurity, and is an element that segregates at a grain boundary to deteriorate the toughness and delayed fracture resistance property of steel. For this reason, the P content is set to 0.100% or less. The P content is preferably 0.050% or less.

It is preferable that the P content is 0%. However, since a dephosphorization cost is increased when the P content is to be excessively reduced, the P content may be set to 0.001% or more.

N: 0.0100% or Less

N is an impurity element, and is an element that forms coarse nitride in steel and lowers the toughness of steel. In addition, N is also an element that facilitates the occurrence of blow holes during spot welding. Furthermore, in a case where B is contained, N is bonded to B and reduces the amount of solute B and deteriorates the hardenability of the steel sheet. For this reason, the N content is set to 0.0100% or less. The N content is preferably 0.0070% or less.

It is preferable that the N content is 0%. However, since a manufacturing cost is increased when the N content is to be excessively reduced, the N content may be set to 0.0001% or more.

The remainder of the chemical composition of the steel sheet included in the hot-dip galvanized steel sheet according to the present embodiment may consist of Fe and impurities. In the present embodiment, impurities mean ores, scraps, or those incorporated from a manufacturing environment as raw materials, and/or those that are permissible within a range that does not adversely affect the hot-stamp formed body manufactured using the hot-dip galvanized steel sheet according to the present embodiment.

The hot-dip galvanized steel sheet according to the present embodiment may contain the following elements as optional elements instead of a portion of Fe. In a case where the following optional elements are not contained, the amount of each optional element is 0%.

Nb: 0% to 0.05%

Nb has an action of forming carbide to refine crystal grains during hot stamping. The refinement of crystal grains causes an increase in the toughness of steel. In order to reliably obtain this effect, it is preferable that the Nb content is set to 0.02% or more. However, when the Nb content is excessively high, there are cases where the above-mentioned effect is saturated and the hardenability of steel decreases. Therefore, the Nb content is set to 0.05% or less.

V: 0% to 0.50%

V is an element that finely forms carbonitride in steel to improve strength. In order to reliably obtain this effect, it is preferable that the V content is set to 0.005% or more.

On the other hand, when the V content exceeds 0.50%, the toughness of steel decreases during spot welding and cracks are likely to occur. For this reason, the V content is set to 0.50% or less.

Cr: 0% to 0.50%

Cr is an element that improves the hardenability of steel. In order to reliably obtain this effect, it is preferable that the Cr content is set to 0.10% or more.

On the other hand, when the Cr content is excessively high, Cr carbide is formed in steel and it is difficult for Cr carbide to be dissolved during heating of hot stamping, so that hardenability deteriorates. For this reason, the Cr content is set to 0.50% or less.

Mo: 0% to 0.50%

Mo is an element that increases the hardenability of steel. In order to reliably obtain this effect, it is preferable that the Mo content is set to 0.005% or more.

However, when the Mo content is excessively high, the above-mentioned effect is saturated. Therefore, the Mo content is set to 0.50% or less.

B: 0% to 0.0100%

B is an element that improves the hardenability of steel. In order to reliably obtain this effect, it is preferable that the B content is set to 0.0001% or more.

On the other hand, even though the B content is excessively high, the effect of improving hardenability is saturated. For this reason, the B content is set to 0.0100% or less.

Ni: 0% to 2.00%

Ni is an element that has an effect of improving the toughness of steel, an effect of suppressing the embrittlement of steel caused by liquid Zn during heating of hot stamping, and an effect of improving the hardenability of steel. In order to reliably obtain these effects, it is preferable that the Ni content is set to 0.01% or more.

On the other hand, even though the Ni content is excessively high, the above-mentioned effects are saturated. For this reason, the Ni content is set to 2.00% or less.

Sum of REM, Ca, Co, and Mg: 0% to 0.0300%

REM, Ca, Co, and Mg are elements that suppress the occurrence of cracks during spot welding by controlling sulfide and oxide in a preferred shape and suppressing the formation of coarse inclusions. In order to reliably obtain this effect, it is preferable that the total amount of REM, Ca, Co, and Mg is set to 0.0003% or more. In order to reliably obtain the above-mentioned effect, the amount of even any one of REM, Ca, Co, and Mg may be 0.0003% or more.

On the other hand, when the total amount of REM, Ca, Co, and Mg is excessively high, inclusions are excessively generated and cracks are likely to occur during spot welding. For this reason, the total amount of REM, Ca, Co, and Mg is set to 0.0300% or less.

The chemical composition of the steel sheet described above may be measured by a general analysis method. For example, the chemical composition of the steel sheet described above may be measured using inductively coupled plasma-atomic emission spectrometry (ICP-AES). C and S may be measured using a combustion-infrared absorption method and N may be measured using an inert gas fusion-thermal conductivity method. The chemical composition may be analyzed after the boundary layer provided on the surface of the hot-dip galvanized steel sheet and the hot-dip galvanized layer are removed by mechanical grinding.

The steel sheet included in the hot-dip galvanized steel sheet according to the present embodiment has the chemical composition described above, has an average grain size of more than 4.0 μm in a region (surface layer region) between the surface of the steel sheet and a depth of 25 μm from the surface of the steel sheet, and has an area ratio of unrecrystallized ferrite of 50% or more in a region between a depth of 50 μm from the surface of the steel sheet and a depth of 100 μm from the surface of the steel sheet. Hereinafter, each requirement will be described in detail.

Surface Layer Region: Average Grain Size is More than 4.0 μm

In the present embodiment, the surface layer region refers to a region between the surface of the steel sheet and a depth of 25 μm from the surface of the steel sheet. By setting the average grain size in the surface layer region to more than 4.0 μm, Fe—Zn alloying between the steel sheet and the hot-dip galvanized layer can progress rapidly and homogeneously during heating in hot stamping. In addition, Zn diffuses into grain boundaries, and these grain boundaries tend to become starting points of an Fe—Zn alloying reaction. Therefore, by causing grains in the surface layer region to coarsen to reduce the number of grain boundaries, the starting points of the Fe—Zn alloying reaction can be reduced. Due to these actions, unevenness of an Fe—Zn solid solution can be reduced, a difference in thermal contraction between the steel sheet and the hot-dip galvanized layer during hot stamping can be reduced, and the formation of voids in the galvanized layer of the hot-stamp formed body can be suppressed. As a result, desired spot weldability cannot be obtained in the hot-stamp formed body. Therefore, in the surface layer region of the steel sheet, the average grain size is set to more than 4.0 μm. It is preferable that the average grain size in the surface layer region of the steel sheet is set to 4.3 μm or more, 4.5 μm or more, or 4.8 μm or more.

An upper limit of the average grain size in the surface layer region of the steel sheet does not need to be particularly limited, but may be set to 14.0 μm or less. From a viewpoint of further improving spot weldability, it is preferable that the average grain size in the surface layer region of the steel sheet is set to 10.0 μm or less.

Method of Measuring Average Grain Size of Surface Layer Region

The average grain size of the surface layer region is measured using electron back scatter diffraction pattern-orientation image microscopy (EBSP-OIM). EBSP-OIM is performed using a device in which a scanning electron microscope and an EBSP analysis device are combined with each other and OIM Analysis (registered trademark) manufactured by AMETEK Inc.

In a region between the surface of the steel sheet and a depth of 25 μm from the surface of the steel sheet in a sheet thickness cross section parallel to a rolling direction, an analysis is performed in at least 5 visual fields in a region having a size of 40 μm×30 μm at a magnification of 1200-fold. A spot where an angle difference between adjacent measurement points is 5° or more is defined as a grain boundary, and equivalent circle diameters of crystal grains are calculated and are regarded as grain sizes. An average value of the obtained grain sizes of crystal grains is calculated, so that an average grain size in the surface layer region is obtained.

The steel sheet, the boundary layer, and the hot-dip galvanized layer may be specified using a method to be described later, and the above-mentioned measurement may be performed for the steel sheet and the specified region.

A method of specifying the steel sheet, the boundary layer, and the hot-dip galvanized layer will be described below.

At a certain position on the hot-dip galvanized steel sheet, concentrations (mass %) of Fe, Zn, and C are measured using glow discharge optical emission spectrometry (GDS) up to a depth of 50 μm from the surface of the hot-dip galvanized steel sheet in a depth direction (sheet thickness direction). In a case where the hot-dip galvanized steel sheet according to the present embodiment is subjected to the GDS measurement, a GDS profile shown in FIG. 1 can be obtained. In the present embodiment, a depth range in which an Fe concentration is 85 mass % or more is defined as the steel sheet and a depth range in which a Zn concentration is 90 mass % or more is defined as the hot-dip galvanized layer. In addition, a depth range between the steel sheet and the hot-dip galvanized layer is defined as the boundary layer.

Region Between Depth of 50 μm from Surface of Steel Sheet and Depth of 100 μm from Surface of Steel Sheet: Area Ratio of Unrecrystallized Ferrite is 50% or More By setting the area ratio of unrecrystallized ferrite to 50% or more in a region between a depth of 50 μm from the surface of the steel sheet and a depth of 100 μm from the surface of the steel sheet, C easily diffuses into grain boundaries near an interface between the steel sheet and the hot-dip galvanized layer in an initial stage of heating during hot stamping. Accordingly, an Fe—Zn alloying reaction rate at the grain boundaries near the interface can be reduced, and a difference in Fe—Zn alloying reaction rate between the grain boundaries near the interface and the other regions can be reduced. Due to these actions, the unevenness of the Fe—Zn solid solution can be reduced, the difference in thermal contraction between the steel sheet and the hot-dip galvanized layer during hot stamping can be reduced, and the formation of voids in the galvanized layer of the hot-stamp formed body can be suppressed. As a result, desired spot weldability cannot be obtained in the hot-stamp formed body. Therefore, the area ratio of unrecrystallized ferrite in the above region is set to 50% or more. The area ratio of unrecrystallized ferrite in the above region is preferably 60% or more.

The area ratio of unrecrystallized ferrite in the above region is not particularly limited, but may be set to 80% or less. From the viewpoint of further improving spot weldability, the area ratio of unrecrystallized ferrite in the above region is preferably set to 70% or less.

In the present embodiment, a remainder in a microstructure other than the unrecrystallized ferrite in the region between a depth of 50 μm from the surface of the steel sheet and a depth of 100 μm from the surface of the steel sheet may contain, by area %, ferrite: 0% to 50%, bainite and martensite: 0% to 50%, pearlite: 0% to 50%, and residual austenite: 0% to 5%. The ferrite mentioned here does not include the unrecrystallized ferrite.

Method of Measuring Area Ratio of Unrecrystallized Ferrite

A test piece having a sheet thickness cross section parallel to the rolling direction of the steel sheet as an observed section is sampled from the hot-dip galvanized steel sheet. After polishing the observed section of the test piece, nital etching is performed. In a region of the observed section between a depth of 50 μm from the surface of the steel sheet and a depth of 100 μm from the surface of the steel sheet, a crystal orientation analysis is performed on a total area of $4.0\times10^{-8}$ $m^2$ or more in one or more visual fields using an electron backscatter diffraction method (EBSD) by FE-SEM. From an obtained crystal orientation map of bcc iron, boundaries having an orientation difference of 5.0° or more are regarded as grain boundaries. Furthermore, intragranular grain orientation spread (GOS) is required, grains having a GOS of 1.0° or more are regarded as unrecrystallized ferrite, and an area ratio thereof is obtained.

For the crystal orientation analysis, OIM Data Collection and OIM Data Analysis manufactured by AMETEK Inc. can be used.

A metallographic structure of an inside of the steel sheet is not particularly limited as long as desired strength and desired spot weldability can be obtained after hot stamping. However, the metallographic structure of the inside of the steel sheet may include, by area %, a sum of unrecrystallized ferrite and ferrite: 0% to 100%, bainite and martensite: 0% to 100%, pearlite: 0% to 80%, and residual austenite: 0% to more than 5%. In the present embodiment, the inside of the steel sheet refers to a ¼ depth position of a sheet thickness of the steel sheet from the surface of the steel sheet (a region between a ⅛ depth of the sheet thickness from the surface of the steel sheet and a ⅜ depth of the sheet thickness from the surface). A metallographic structure at this position shows a representative metallographic structure of the steel sheet. The metallographic structure of the steel sheet may be measured using the following methods.

Method of Measuring Area Ratios of Ferrite and Pearlite)

The measurement of area ratios of ferrite and pearlite is performed using the following method. A test piece having a sheet thickness cross section parallel to the rolling direction of the steel sheet as an observed section is sampled from the hot-dip galvanized steel sheet. The observed section of the test piece is mirror-finished and is polished for 8 minutes at room temperature using colloidal silica, which does not contain an alkaline solution, to remove strain introduced into the observed section. A region which has a length of 50 μm and is present between a ⅛ depth of the sheet thickness from the surface of the steel sheet and a ⅜ depth of the sheet thickness from the surface of the steel sheet is measured at a measurement interval of 0.1 μm using an electron backscatter diffraction method to obtain crystal orientation information at a certain position of the observed section in the rolling direction of the steel sheet so that the ¼ depth of the sheet thickness from the surface can be analyzed. An apparatus equipped with a schottky emission scanning electron microscope (JSM-7001F manufactured by JEOL Ltd.) and an EBSP detector (DVC5 detector manufactured by AMETEK Inc.) is used for the measurement. In this case, the degree of vacuum in the apparatus is set to $9.6\times10^{-5}$ Pa or less, an accelerating voltage is set to 15 kV, an irradiation current level is set to 13, and an irradiation level of an electron beam is set to 62. Furthermore, a reflected electron image is taken in the same visual field.

First, grains in which ferrite and cementite are precipitated in layers are specified from the reflected electron image and an area ratio of the grains is calculated, so that an area ratio of pearlite is obtained. Thereafter, with regard to grains excluding the grains that are determined as pearlite, a region where a grain average misorientation value is 1.0° or less is determined as ferrite from the obtained crystal orientation information using "Grain Average Misorientation" function provided in software "OIM Analysis (registered trademark)" incorporated in the EBSP analysis device. An area ratio of the region determined as ferrite is obtained, so that an area ratio of ferrite is obtained.

Method of Measuring Area Ratio of Residual Austenite

An area ratio of residual austenite is measured using an electron backscatter diffraction method (EBSD). For an analysis by EBSD, a test piece sampled at the same sampling position as when measuring the area ratios of ferrite and pearlite described above is used. In order to analyze the ¼ depth of the sheet thickness from the surface of the steel sheet, a region which has a length of 50 μm and is present between a ⅛ depth of the sheet thickness from the surface of the steel sheet and a ⅜ depth of the sheet thickness from the surface of the steel sheet is measured. After polishing the observed section of the test piece is polished using #600 to #1500 silicon carbide paper, the observed section is mirror-finished using a liquid obtained by dispersing a diamond powder having a particle size of 1 to 6 μm in a diluted solution such as alcohol or pure water. Thereafter, strain of the observed section is sufficiently removed by electrolytic polishing. In the electrolytic polishing, in order to remove mechanical polishing strain on the observed section, the test piece may be polished by a thickness of a minimum of 20 μm and a maximum of 50 μm. Considering a shear droop of an end portion, it is preferable that the test piece is polished by a thickness of 30 μm or less.

With regard to measurement in EBSD, an accelerating voltage is set to 15 to 25 kV, the measurement is performed at intervals of at least 0.25 μm or less, and crystal orientation information about each measurement point in a range of 150 μm or more in the sheet thickness direction and 250 μm or more in the rolling direction is obtained. In the obtained crystal structure, a measurement point at which a crystal structure is fcc is determined as residual austenite using "PhaseMap" function provided in software "OIM Analysis (registered trademark)" incorporated in the EBSD analysis device. A ratio of the measurement points, which are determined as residual austenite, is obtained, so that the area ratio of residual austenite is obtained. Here, since a larger number of measurement points are more preferable, it is preferable that a measurement interval is narrow and a measurement range is wide. However, in a case where the measurement interval is less than 0.01 μm, adjacent points interfere with an expansion width of an electron beam. For this reason, the measurement interval is set to 0.01 μm or more. In addition, the measurement range may be set to 200 μm in the sheet thickness direction and 400 μm in a sheet width direction at the maximum. Furthermore, the apparatus equipped with the schottky emission scanning electron microscope (JSM-7001F manufactured by JEOL Ltd.) and the EBSP detector (DVC5 detector manufactured by AMETEK Inc.) is used for the measurement. In this case, the degree of vacuum in the apparatus is set to $9.6\times10^{-5}$ Pa or less, the irradiation current level is set to 13, and the irradiation level of the electron beam is set to 62.

Method of Measuring Area Ratios of Bainite and Martensite

The sum of the area ratios of bainite and martensite is a value obtained by subtracting the sum of the area ratios of ferrite and pearlite and the area ratio of residual austenite measured using the above-mentioned method from 100%.

The hot-dip galvanized steel sheet according to the present embodiment includes the above-mentioned steel sheet, the boundary layer provided on the steel sheet, and the hot-dip galvanized layer provided on the boundary layer. The boundary layer and the hot-dip galvanized layer will be described below.

Boundary Layer

In the present embodiment, the boundary layer refers to a layer that is present between the above-mentioned steel sheet and the hot-dip galvanized layer described later. In the present embodiment, a depth range in which the Fe concentration is 85 mass % or more is defined as the steel sheet and a depth range in which the Zn concentration is 90 mass % or more is defined as the hot-dip galvanized layer. From this, the boundary layer can be defined as a depth range in which the Fe concentration is less than 85 mass % and the Zn concentration is less than 90 mass %.

Hot-Dip Galvanized Layer

In the present embodiment, the hot-dip galvanized layer refers to a layer of which the Zn concentration is 90 mass % or more. When a maximum value of the C concentration in the hot-dip galvanized layer is less than 0.05 mass %, evaporation of zinc in the hot-dip galvanized layer during heating in hot stamping cannot be suppressed, and a large amount of voids are formed in the hot-stamp formed body. As a result, desired spot weldability cannot be obtained in the hot-stamp formed body. Therefore, the maximum value of C concentration in the hot-dip galvanized layer is set to 0.05 mass % or more. The maximum value of C concentration in the hot-dip galvanized layer is preferably 0.10 mass % or more, or 0.15 mass % or more.

Although an upper limit of the maximum value of the C concentration in the hot-dip galvanized layer is not particularly limited, the upper limit may be set to 0.50 mass % or less.

The hot-dip galvanized layer may contain 0.01 mass % to 1.00 mass % of Al as an element other than Zn. In addition, 10 mass % or less of Fe may be contained in the hot-dip galvanized layer as a remainder.

Method of Measuring Maximum Value of C Concentration in Hot-Dip Galvanized Layer At certain five points on the hot-dip galvanized steel sheet, the concentrations (mass %) of Fe, Zn, and C are measured using glow discharge optical emission spectrometry (GDS) up to a depth of 50 μm from the surface in the depth direction (sheet thickness direction). At each measurement point, a depth range in which the Fe concentration is 85 mass % or more is defined as the steel sheet, a depth range in which the Zn concentration is 90 mass % or more is defined as the hot-dip galvanized layer, and a depth range between the steel sheet and the hot-dip galvanized layer is defined as the boundary layer. Next, the maximum value of the C concentration (mass %) in the depth range defined as the hot-dip galvanized layer is obtained. The maximum value of the C concentration in the hot-dip galvanized layer is obtained by calculating an average value of the maximum values of C concentrations in the depth range defined as the hot-dip galvanized layer at each measurement point.

Sheet Thickness

A sheet thickness of the hot-dip galvanized steel sheet according to the present embodiment is not particularly limited, but is preferably set to 0.5 mm to 3.5 mm from a viewpoint of a reduction in weight of a vehicle body.

Next, a preferable method of manufacturing the hot-dip galvanized steel sheet according to the present embodiment will be described.

First, a slab having the above-mentioned chemical composition is heated to 1200° C. or higher, is held in a temperature range of 1200° C. or higher for 20 minutes or longer, and is then subjected to hot rolling. Finish rolling is ended in a temperature range of 810° C. or higher, and coiling is performed in a temperature range of 550° C. to 750° C. Thereafter, holding is performed in a temperature range of 700° C. or higher for 15 minutes or longer and shorter than 120 minutes.

In the preferable method of manufacturing the hot-dip galvanized steel sheet according to the present embodiment, after the hot rolling and the coiling, holding is performed in a temperature range of 700° C. or higher for 15 minutes or longer and shorter than 120 minutes. Accordingly, grains in the surface layer region of the steel sheet can be coarsened, and a desired amount of unrecrystallized ferrite can be obtained in the region between a depth of 50 μm from the surface of the steel sheet and a depth of 100 μm from the surface of the steel sheet.

In addition, in the holding in a temperature range of 700° C. or higher, a temperature of the steel sheet may be changed or may be kept constant. An upper limit of the holding temperature may be an $Ac_1$ point or lower from the viewpoint of suppressing the generation of hard phases generated by low temperature transformation such as martensite and bainite and from a viewpoint of refining the average grain size of the surface layer region. The $Ac_1$ point can be represented by Expression (1) below.

$$Ac_1(°\ C.)=723-10.7\times Mn+29.1\times Si-16.9\times Ni+16.9\times Cr \quad (1)$$

where a symbol of an element in Expression (1) represents the amount of the corresponding element by mass %. In a case where the corresponding element is not contained, 0 is substituted.

After performing the holding in a temperature range of 700° C. or higher for 15 minutes or longer and shorter than 120 minutes, cold rolling is performed as necessary and hot-dip galvanizing is applied. Pickling may be performed between the hot rolling and the cold rolling. The cold rolling may be cold rolling in which a normal cumulative rolling reduction, for example, a cumulative rolling reduction is 30% to 90%.

The hot-dip galvanizing may be performed using a continuous hot-dip galvanizing line. An adhesion amount of the hot-dip galvanized layer is not particularly limited and may be a general adhesion amount. For example, a plating adhesion amount per side may be set to 5 to 150 g/m$^2$.

When the hot-dip galvanized layer is alloyed into a hot-dip galvannealed layer, a Γ phase having a high Zn concentration in a plating layer exhibiting a sacrificial protection action disappears, resulting in a reduction in corrosion resistance. Electrogalvanizing requires additional elements for delaying alloying, so that a manufacturing cost increases, which is not desirable.

The hot-dip galvanized steel sheet according to the present embodiment can be manufactured using the above-mentioned method.

In a case where a hot-stamp formed body is to be manufactured, it is preferable that the hot-dip galvanized steel sheet according to the present embodiment is subjected to hot stamping under the following conditions.

First, it is preferable that the hot-dip galvanized steel sheet according to the present embodiment is heated so that a heating temperature is in a range of higher one of "the $Ac_3$ point and 800° C." to 950° C. In addition, it is preferable that a heating time (a time that has passed until the hot-dip galvanized steel sheet is taken out of a heating furnace after being put in the heating furnace and then held at the heating temperature (a time having passed between carrying the hot-dip galvanized steel sheet in the heating furnace and carrying the hot-dip galvanized steel sheet out the heating furnace)) is set to 60 to 600 seconds. The $Ac_3$ point is represented by Expression (2) below.)

$$Ac_3(°\ C.)=910-203\times C^{0.5}-30\times Mn+44.7\times Si+400\times Ti \quad (2)$$

where a symbol of an element in Expression (2) represents the amount of the corresponding element by mass %.

By setting the heating temperature to a temperature equal to or higher than higher one of "the $Ac_3$ point and 800° C." and setting the heating time to 60 seconds or longer, sufficient austenitizing can be achieved. As a result, a hot-stamp formed body having desired strength can be obtained. By setting the heating temperature to 950° C. or lower and setting the heating time to 600 seconds or shorter, excessive alloying can be suppressed. An average heating rate during the heating may be set to 0.1 to 200° C./s. The average heating rate mentioned here is a value obtained by dividing a temperature difference between the surface temperature of the steel sheet at the time of start of the heating and the heating temperature by a time difference from the start of the heating to a time when the heating temperature is reached. The temperature of the steel sheet may be changed or kept constant during the holding in a temperature range of higher one of "the $Ac_3$ point and 800° C." to 950° C.

Examples of a heating method to be performed before the hot stamping include heating using an electric furnace, a gas furnace, or the like, flame heating, electrical resistance heating, high-frequency heating, and induction heating.

Hot stamping is performed after the heating and the holding described above. After the hot stamping, it is preferable that cooling is performed at an average cooling rate of 20 to 500° C./s up to a temperature range of, for example, 250° C. or lower.

A hot-stamp formed body manufactured using the hot-dip galvanized steel sheet according to the present embodiment can be obtained using the above-described method. Since the formation of voids in a galvanized layer (a hot-dip galvanized layer obtained after the hot stamping) is suppressed, this hot-stamp formed body is excellent in spot weldability and has strength generally required for a hot-stamp formed body.

Examples

Next, examples of the present invention will be described. Conditions in the examples are one example of conditions adopted to confirm the feasibility and effects of the present invention, and the present invention is not limited to this example of conditions. The present invention may employ various conditions to achieve the object of the present invention without departing from the scope of the present invention.

Slabs manufactured by casting molten steel having a chemical composition shown in Tables 1A and 1B were heated to 1200° C. or higher, were held for 20 minutes or longer, were subjected to hot rolling so that a finish rolling completion temperature became 810° C. or higher, and were coiled in a temperature range of 550° C. to 750° C. Next, the resultants were heated to a temperature shown in Tables 2A and 2B and held at the temperature. Thereafter, the resultants were subjected to cold rolling, thereby obtaining steel sheets.

A cumulative rolling reduction during the cold rolling was set to 30% to 90%. A hot-dip galvanized layer was formed on the obtained steel sheets by a continuous hot-dip galvanizing line, thereby obtaining hot-dip galvanized steel sheets shown in Tables 2A and 2B. An adhesion amount of the hot-dip galvanized layer was set to 5 to 150 g/m$^2$ per side.

For the obtained hot-dip galvanized steel sheets, an average grain size in a region (surface layer region) between a surface of the steel sheet and a depth of 25 μm from the surface of the steel sheet, a metallographic structure of a region between a depth of 50 μm from the surface of the steel sheet and a depth of 100 μm from the surface of the steel sheet, and a maximum value of a C concentration of the hot-dip galvanized layer were measured using the above-described methods. In Tables 2A and 2B, "Average grain size" is the average grain size in the region (surface layer region) between the surface of the steel sheet and a depth of 25 μm from the surface of the steel sheet, and "Unrecrystallized a" is an area ratio of unrecrystallized ferrite in the region between a depth of 50 μm from the surface of the steel sheet and a depth of 100 μm from the surface of the steel sheet.

Hot-stamp formed bodies shown in Tables 2A and 2B were manufactured using the obtained hot-dip galvanized steel sheets under conditions shown in Tables 2A and 2B. An average heating rate during heating performed before hot stamping was set to 0.1 to 200° C./s, and cooling was performed at an average cooling rate of 20 to 500° C./s up to a temperature range of 250° C. or lower after the hot stamping.

An underline in the tables represents that a condition is out of the range of the present invention, a condition is out of a preferable manufacturing condition, or a property value is not preferable.

For the obtained hot-stamp formed bodies, a cross-sectional area ratio of voids present in a galvanized layer included the hot-stamp formed body was measured using the following method.

First, a test piece was cut out from a position 50 mm or more away from an end surface of the hot-stamp formed body (a position that avoids an end portion in a case where the test piece cannot be sampled from this position) so that a cross section (sheet thickness cross section) perpendicular to a surface was an observed section. A size of the test piece was set to a size that allows the size to be observed by about 10 mm in a rolling direction.

Next, the observed section was polished and photographed using a scanning electron microscope (SEM) at a magnification of 300-fold. Thereafter, the cross-sectional area ratio of voids was calculated by binarization image processing. For the calculation of the cross-sectional area ratio of voids, built-in software of a digital microscope VHX-5000 manufactured by Keyence Corporation was used to determine the voids using luminance and to automatically measure the area of the voids.

A steel sheet and the galvanized layer included in the hot-stamp formed body were identified by performing line analysis along a sheet thickness direction using SEM-energy dispersive X-ray spectroscopy (EDS) and performing quantitative analysis of Fe concentrations. In these examples, SEM (NB5000 manufactured by Hitachi High-Tech Corporation), EDS (XFlash(r)6|30 manufactured by Bruker AXS Inc.), and EDS analysis software (ESPRIT1.9 manufactured by Bruker AXS Inc.) were used. When an observation was made using SEM, a region, which was present at a position closest to a sheet thickness center portion in the sheet thickness direction and an Fe content of more than 80 mass % excluding measurement noise, was determined as the steel sheet, and other regions were determined as the galvanized layer.

Mechanical properties (tensile strength and spot weldability) of the hot-stamp formed bodies were evaluated using the following methods.

Tensile Strength

No. 5 test pieces described in JIS Z 2241:2011 were prepared from a certain position of the hot-stamp formed body, and the tensile strength of the hot-stamp formed body was obtained according to a test method described in JIS Z 2241:2011. In a case where the tensile strength was in a range of 1500 to 2500 MPa, the test piece was determined to be acceptable since having strength generally required for a hot-stamp formed body. In a case where the tensile strength was less than 1500 MPa, the test piece was determined to be unacceptable since having insufficient strength. In a case where the tensile strength exceeded 2500 MPa, the test piece was determined to be unacceptable since being insufficient in toughness and ductility due to excessively high strength.

Spot Weldability

For the hot-stamp formed bodies, two test pieces having a size of 100 mm×30 mm were sampled from a position excluding a region within 10 mm from an end surface, the test pieces were overlapped with each other, and spot welding was performed while current was changed under the following conditions.

Electrode force: 400 kgf

Weld time: 15 cycles

Holding time: 9 cycles

Shape of electrode tip: DR type, tip ϕ6 mm-radius of curvature R40 mm

Current at which a nugget diameter was $4\sqrt{t}$ (t is the sheet thickness of the test piece) was indicated as $I_0$, spot welding was performed while increasing the current, and current (electrode sticking current $I_s$) at which electrode sticking occurred was obtained.

In addition, spot weldability for the obtained electrode sticking current $I_s$ was evaluated on the basis of the following criteria. Here, $I_0$ (kA) is the current at which a nugget diameter was $4\sqrt{t}$ (t is the sheet thickness of the test piece), and a continuous spot welding current $I_a$ (kA) is $I_0 \times 1.4$. Examples evaluated as good and fair were determined to be acceptable since being excellent in spot weldability. On the other hand, examples evaluated as bad were determined to be unacceptable since being insufficient in spot weldability.

Good: $I_s > I_a \times 1.15$

Fair: $I_a \times 1.10 < I_s \leq I_a \times 1.15$

Bad: $I_s \leq I_a \times 1.10$

TABLE 1A

| Steel | Chemical composition (mass %) Remainder Fe and impurities | | | | | | | | | $A_{c3}$ | $A_{c1}$ | |
|---|---|---|---|---|---|---|---|---|---|---|---|---|
| No. | C | Si | Mn | Al | Ti | S | P | N | Others | (° C.) | (° C.) | Note |
| 1 | 0.19 | 0.20 | 2.00 | 0.030 | 0.025 | 0.0020 | 0.004 | 0.0030 | | 780 | 707 | Steel of Present Invention |
| 2 | 0.49 | 0.15 | 2.00 | 0.030 | 0.035 | 0.0020 | 0.010 | 0.0030 | | 729 | 706 | Steel of Present Invention |
| 3 | 0.31 | 0.10 | 2.00 | 0.040 | 0.025 | 0.0020 | 0.010 | 0.0030 | | 751 | 705 | Steel of Present Invention |
| 4 | 0.31 | 1.40 | 2.00 | 0.040 | 0.025 | 0.0020 | 0.010 | 0.0030 | | 810 | 742 | Steel of Present Invention |
| 5 | 0.33 | 0.20 | 0.50 | 0.040 | 0.025 | 0.0020 | 0.015 | 0.0051 | | 797 | 723 | Steel of Present Invention |
| 6 | 0.33 | 0.20 | 2.50 | 0.040 | 0.025 | 0.0020 | 0.015 | 0.0051 | | 737 | 702 | Steel of Present Invention |
| 7 | 0.33 | 0.15 | 1.80 | 0.050 | 0.050 | 0.0002 | 0.090 | 0.0051 | | 766 | 708 | Steel of Present Invention |
| 8 | 0.33 | 0.15 | 1.80 | 0.050 | 0.050 | 0.0100 | 0.090 | 0.0051 | | 766 | 708 | Steel of Present Invention |
| 9 | 0.34 | 0.15 | 1.50 | 0.040 | 0.010 | 0.0030 | 0.010 | 0.0050 | | 757 | 711 | Steel of Present Invention |
| 10 | 0.34 | 0.15 | 1.50 | 0.040 | 0.100 | 0.0030 | 0.010 | 0.0050 | | 793 | 711 | Steel of Present Invention |
| 11 | 0.33 | 0.15 | 1.50 | 0.040 | 0.025 | 0.0020 | 0.090 | 0.0051 | | 765 | 711 | Steel of Present Invention |
| 12 | 0.33 | 0.15 | 1.50 | 0.040 | 0.025 | 0.0020 | 0.001 | 0.0051 | | 765 | 711 | Steel of Present Invention |
| 13 | 0.23 | 0.14 | 2.00 | 0.095 | 0.027 | 0.0028 | 0.015 | 0.0030 | | 770 | 706 | Steel of Present Invention |

TABLE 1A-continued

| Steel No. | Chemical composition (mass %) Remainder Fe and impurities C | Si | Mn | Al | Ti | S | P | N | Others | $A_{c3}$ (° C.) | $A_{c1}$ (° C.) | Note |
|---|---|---|---|---|---|---|---|---|---|---|---|---|
| 14 | 0.23 | 0.14 | 2.00 | 0.005 | 0.027 | 0.0028 | 0.015 | 0.0030 | | 770 | 706 | Steel of Present Invention |
| 15 | 0.23 | 0.14 | 2.00 | 0.030 | 0.027 | 0.0028 | 0.015 | 0.0098 | | 770 | 706 | Steel of Present Invention |
| 16 | 0.23 | 0.14 | 2.00 | 0.030 | 0.027 | 0.0028 | 0.015 | 0.0030 | | 770 | 706 | Steel of Present Invention |
| 17 | 0.33 | 0.20 | 2.00 | 0.040 | 0.025 | 0.0020 | 0.010 | 0.0051 | Nb: 0.05 | 752 | 707 | Steel of Present Invention |
| 18 | 0.33 | 0.20 | 2.00 | 0.040 | 0.025 | 0.0020 | 0.010 | 0.0051 | V: 0.20 | 752 | 707 | Steel of Present Invention |
| 19 | 0.33 | 0.20 | 2.00 | 0.040 | 0.025 | 0.0020 | 0.010 | 0.0051 | Cr: 0.20 | 752 | 711 | Steel of Present Invention |
| 20 | 0.33 | 0.22 | 1.90 | 0.040 | 0.022 | 0.0020 | 0.010 | 0.0051 | Mo: 0.023 | 755 | 709 | Steel of Present Invention |

TABLE 1B

| Steel No. | Chemical composition (mass %) Remainder Fe and impurities C | Si | Mn | Al | Ti | S | P | N | Others | $A_{c3}$ (° C.) | $A_{c1}$ (° C.) | Note |
|---|---|---|---|---|---|---|---|---|---|---|---|---|
| 21 | 0.34 | 0.25 | 1.90 | 0.040 | 0.023 | 0.0020 | 0.020 | 0.0050 | B: 0.0034 | 755 | 710 | Steel of Present Invention |
| 22 | 0.33 | 0.25 | 2.00 | 0.040 | 0.022 | 0.0020 | 0.020 | 0.0051 | Ni: 0.04 | 753 | 708 | Steel of Present Invention |
| 23 | 0.31 | 0.20 | 2.10 | 0.040 | 0.024 | 0.0020 | 0.010 | 0.0052 | Mg: 0.0010 | 753 | 706 | Steel of Present Invention |
| 24 | 0.31 | 0.20 | 2.10 | 0.040 | 0.024 | 0.0020 | 0.010 | 0.0052 | Ca: 0.0011, Mg: 0.0010 | 753 | 706 | Steel of Present Invention |
| 25 | 0.31 | 0.20 | 2.00 | 0.040 | 0.024 | 0.0020 | 0.010 | 0.0052 | REM: 0.0009, Co: 0.0054 | 756 | 707 | Steel of Present Invention |
| 26 | 0.17 | 0.20 | 2.00 | 0.040 | 0.022 | 0.0020 | 0.010 | 0.0051 | | 784 | 707 | Comparative Steel |
| 27 | 0.52 | 0.20 | 2.00 | 0.040 | 0.022 | 0.0020 | 0.010 | 0.0049 | | 721 | 707 | Comparative Steel |
| 28 | 0.23 | 1.60 | 1.80 | 0.050 | 0.023 | 0.0020 | 0.010 | 0.0050 | | 839 | 750 | Comparative Steel |
| 29 | 0.22 | 0.20 | 0.40 | 0.050 | 0.025 | 0.0040 | 0.009 | 0.0049 | | 822 | 725 | Comparative Steel |
| 30 | 0.49 | 0.20 | 2.60 | 0.050 | 0.025 | 0.0040 | 0.009 | 0.0048 | | 709 | 701 | Comparative Steel |
| 31 | 0.22 | 0.20 | 2.00 | 0.040 | 0.020 | 0.0130 | 0.010 | 0.0050 | | 772 | 707 | Comparative Steel |
| 32 | 0.22 | 0.20 | 1.60 | 0.040 | 0.008 | 0.0010 | 0.010 | 0.0050 | | 779 | 712 | Comparative Steel |
| 33 | 0.22 | 0.20 | 1.06 | 0.040 | 0.110 | 0.0010 | 0.010 | 0.0051 | | 820 | 712 | Comparative Steel |
| 34 | 0.22 | 0.20 | 2.00 | 0.040 | 0.020 | 0.0010 | 0.110 | 0.0050 | | 772 | 707 | Comparative Steel |
| 35 | 0.22 | 0.20 | 1.80 | 0.020 | 0.030 | 0.0030 | 0.020 | 0.0158 | | 782 | 710 | Comparative Steel |
| 36 | 0.35 | 0.05 | 1.30 | 0.040 | 0.020 | 0.0020 | 0.005 | 0.0020 | | 761 | 711 | Comparative Steel |

An underline represents that a condition is out of the range of the present invention.

TABLE 2A

| | | Heating after coiling | | Steel sheet | | Hot-dip galvanized layer | HS conditions | | Hot-stamp formed body | | Spot weldability | | | | | |
|---|---|---|---|---|---|---|---|---|---|---|---|---|---|---|---|---|
| Manufacture No. | Steel No. | Heating temperature (° C.) | Holding time (min) | Average grain size (μm) | Unrecrystallized α (area %) | Maximum value of C concentration (mass %) | Heating temperature (° C.) | Heating time (sec) | Void cross-sectional area ratio (%) | Tensile strength (MPa) | 4√t current $I_o$ (kA) | Continuous spot welding current $I_a$ (kA) | OK determination criteria (kA) | Electrode sticking current $I_s$ (kA) | Determination | Note |
| 1 | 1 | 700 | 30 | 7.8 | 59 | 0.05 | 850 | 120 | 10.0 | 1500 | 5.90 | 8.26 | 9.50 | 10.00 | Good | Example of Present Invention |
| 2 | 2 | 700 | 30 | 7.5 | 55 | 0.11 | 850 | 120 | 6.0 | 2475 | 5.70 | 7.98 | 9.18 | 10.00 | Good | Example of Present Invention |
| 3 | 3 | 700 | 30 | 8.0 | 62 | 0.08 | 850 | 120 | 7.0 | 1975 | 5.70 | 7.98 | 9.18 | 9.50 | Good | Example of Present Invention |
| 4 | 4 | 700 | 30 | 7.2 | 58 | 0.10 | 850 | 120 | 6.9 | 2010 | 5.80 | 8.12 | 9.34 | 10.00 | Good | Example of Present Invention |
| 5 | 5 | 700 | 30 | 6.9 | 59 | 0.07 | 850 | 120 | 8.5 | 2000 | 5.70 | 7.98 | 9.18 | 10.00 | Good | Example of Present Invention |
| 6 | 6 | 700 | 30 | 8.5 | 53 | 0.06 | 850 | 120 | 4.0 | 2060 | 5.80 | 8.12 | 9.34 | 10.50 | Good | Example of Present Invention |
| 7 | 7 | 700 | 30 | 7.3 | 60 | 0.07 | 850 | 120 | 5.5 | 2000 | 5.70 | 7.98 | 9.18 | 10.00 | Good | Example of Present Invention |
| 8 | 8 | 700 | 30 | 7.8 | 53 | 0.08 | 850 | 120 | 6.2 | 1980 | 5.70 | 7.98 | 9.18 | 9.50 | Good | Example of Present Invention |
| 9 | 9 | 700 | 30 | 5.9 | 57 | 0.07 | 850 | 120 | 6.0 | 1975 | 5.70 | 7.98 | 9.18 | 10.00 | Good | Example of Present Invention |
| 10 | 10 | 700 | 30 | 6.8 | 62 | 0.08 | 850 | 120 | 7.9 | 2050 | 5.90 | 8.26 | 9.50 | 10.00 | Good | Example of Present Invention |
| 11 | 11 | 700 | 30 | 5.5 | 58 | 0.08 | 850 | 120 | 9.4 | 1975 | 5.70 | 7.98 | 9.18 | 10.00 | Good | Example of Present Invention |
| 12 | 12 | 700 | 30 | 7.5 | 64 | 0.08 | 850 | 120 | 8.1 | 2010 | 5.80 | 8.12 | 9.34 | 10.00 | Good | Example of Present Invention |
| 13 | 13 | 700 | 30 | 5.5 | 68 | 0.08 | 850 | 120 | 11.0 | 1555 | 5.60 | 7.84 | 9.02 | 10.00 | Good | Example of Present Invention |

TABLE 2A-continued

| | | | | | | Hot-dip galvanized layer | | | Hot-stamp formed body | | | | | | | |
|---|---|---|---|---|---|---|---|---|---|---|---|---|---|---|---|---|
| | | | | | | | | | | | Spot weldability | | | | | |
| | | Heating after coiling | | Steel sheet | | | HS conditions | | | | | | | | | |
| Manufacture No. | Steel No. | Heating temperature (° C.) | Holding time (min) | Average grain size (μm) | Unrecrystallized α (area %) | Maximum value of C concentration (mass %) | Heating temperature (° C.) | Heating time (sec) | Void cross-sectional area ratio (%) | Tensile strength (MPa) | 4✓t current $I_o$ (kA) | Continuous spot welding current $I_\sigma$ (kA) | OK determination criteria (kA) | Electrode sticking current $I_s$ (kA) | Determination | Note |
| 14 | 14 | 700 | 30 | 7.2 | 54 | 0.07 | 850 | 120 | 10.0 | 1505 | 5.90 | 8.26 | 9.50 | 10.00 | Good | Example of Present Invention |
| 15 | 15 | 700 | 30 | 7.4 | 60 | 0.08 | 850 | 120 | 6.0 | 1530 | 5.70 | 7.98 | 9.18 | 10.00 | Good | Example of Present Invention |
| 16 | 16 | 700 | 30 | 7.4 | 62 | 0.08 | 850 | 120 | 5.0 | 1540 | 5.70 | 7.98 | 9.18 | 10.50 | Good | Example of Present Invention |
| 17 | 17 | 700 | 30 | 7.1 | 60 | 0.08 | 850 | 120 | 4.3 | 2010 | 5.90 | 8.26 | 9.50 | 10.00 | Good | Example of Present Invention |
| 18 | 18 | 700 | 30 | 7.0 | 66 | 0.09 | 850 | 120 | 4.5 | 2080 | 5.80 | 8.12 | 9.34 | 10.50 | Good | Example of Present Invention |
| 19 | 19 | 700 | 30 | 7.4 | 62 | 0.07 | 850 | 120 | 5.7 | 2030 | 5.70 | 7.98 | 9.18 | 10.00 | Good | Example of Present Invention |
| 20 | 20 | 700 | 30 | 6.9 | 59 | 0.08 | 850 | 120 | 8.9 | 2075 | 5.80 | 8.12 | 9.34 | 10.00 | Good | Example of Present Invention |

An underline represents that a condition is out of the range of the present invention, a manufacturing condition is not preferable, or properties are not preferable.

TABLE 2B

| | | | | | | Hot-dip galvanized layer | | | Hot-stamp formed body | | | | | | | |
|---|---|---|---|---|---|---|---|---|---|---|---|---|---|---|---|---|
| | | | | | | | | | | | Spot weldability | | | | | |
| | | Heating after coiling | | Steel sheet | | | HS conditions | | Void | | | Continuous | OK | Electrode | | |
| Manufacture No. | Steel No. | Heating temperature (° C.) | Holding time (min) | Average grain size (μm) | Unrecrystallized α (area %) | Maximum value of C concentration (mass %) | Heating temperature (° C.) | Heating time (sec) | cross-sectional area ratio (%) | Tensile strength (MPa) | 4√t current $I_o$ (kA) | spot welding current $I_a$ (kA) | determination criteria (kA) | sticking current $I_s$ (kA) | Determination | Note |
| 21 | 21 | 700 | 30 | 7.1 | 55 | 0.09 | 850 | 120 | 9.7 | 2080 | 6.00 | 8.40 | 9.66 | 10.00 | Good | Example of Present Invention |
| 22 | 22 | 700 | 30 | 6.5 | 62 | 0.08 | 850 | 120 | 7.6 | 2075 | 5.80 | 8.12 | 9.34 | 10.50 | Good | Example of Present Invention |
| 23 | 23 | 700 | 30 | 7.0 | 60 | 0.07 | 820 | 60 | 6.0 | 2010 | 5.70 | 7.98 | 9.18 | 10.00 | Good | Example of Present Invention |
| 24 | 24 | 700 | 30 | 6.8 | 57 | 0.08 | 820 | 60 | 8.8 | 2020 | 5.90 | 8.26 | 9.50 | 10.00 | Good | Example of Present Invention |
| 25 | 25 | 700 | 30 | 7.0 | 56 | 0.07 | 820 | 60 | 7.1 | 2000 | 6.00 | 8.40 | 9.66 | 10.00 | Good | Example of Present Invention |
| 26 | 26 | 700 | 30 | 7.2 | 55 | 0.07 | 850 | 120 | 5.5 | 1460 | 6.00 | 8.40 | 9.66 | 10.00 | Good | Comparative Example |
| 27 | 27 | 700 | 30 | 8.6 | 52 | 0.13 | 850 | 120 | 6.8 | 2560 | 5.80 | 8.12 | 9.34 | 9.50 | Good | Comparative Example |
| 28 | 28 | 700 | 30 | 7.2 | 64 | 0.07 | 820 | 120 | 5.2 | 1405 | 5.80 | 8.12 | 9.34 | 10.00 | Good | Comparative Example |
| 29 | 29 | 700 | 30 | 7.1 | 60 | 0.07 | 820 | 120 | 5.7 | 1410 | 5.90 | 8.26 | 9.50 | 10.00 | Good | Comparative Example |
| 30 | 30 | 700 | 30 | 7.8 | 61 | 0.10 | 820 | 120 | 5.0 | 2590 | 6.00 | 8.40 | 9.66 | 10.00 | Good | Comparative Example |
| 31 | 31 | 700 | 30 | 7.2 | 65 | 0.06 | 820 | 60 | 9.0 | 1450 | 5.80 | 8.12 | 9.34 | 10.00 | Good | Comparative Example |
| 32 | 32 | 700 | 30 | 7.3 | 63 | 0.06 | 820 | 60 | 7.2 | 1430 | 6.10 | 8.54 | 9.82 | 10.00 | Good | Comparative Example |
| 33 | 33 | 700 | 30 | 7.2 | 60 | 0.07 | 820 | 60 | 6.2 | 1385 | 5.90 | 8.26 | 9.50 | 10.00 | Good | Comparative Example |

TABLE 2B-continued

| | | Heating after coiling | | Steel sheet | | Hot-dip galvanized layer | HS conditions | | Hot-stamp formed body | | Spot weldability | | | | | |
|---|---|---|---|---|---|---|---|---|---|---|---|---|---|---|---|---|
| Manufacture No. | Steel No. | Heating temperature (° C.) | Holding time (min) | Average grain size (μm) | Unrecrystallized α (area %) | Maximum value of C concentration (mass %) | Heating temperature (° C.) | Heating time (sec) | Void cross-sectional area ratio (%) | Tensile strength (MPa) | 4✓t current $I_o$ (kA) | Continuous spot welding current $I_\sigma$ (kA) | OK determination criteria (kA) | Electrode sticking current $I_s$ (kA) | Determination | Note |
| 34 | 34 | 700 | 30 | 7.0 | 61 | 0.11 | 820 | 60 | 10.1 | 1455 | 6.00 | 8.40 | 9.66 | 10.00 | Good | Comparative Example |
| 35 | 35 | 700 | 30 | 7.0 | 63 | 0.07 | 820 | 60 | 9.5 | 1460 | 5.80 | 8.12 | 9.34 | 10.00 | Good | Comparative Example |
| 36 | 16 | 700 | 10 | 4.3 | 75 | 0.04 | 850 | 120 | 16.6 | 1560 | 6.00 | 8.40 | 9.66 | 9.00 | Bad | Comparative Example |
| 37 | 16 | 700 | 180 | 12.0 | 34 | 0.12 | 850 | 120 | 17.9 | 1530 | 6.00 | 8.40 | 9.66 | 9.00 | Bad | Comparative Example |
| 38 | 16 | 600 | 30 | 3.1 | 54 | 0.05 | 850 | 120 | 16.2 | 1580 | 6.00 | 8.40 | 9.66 | 9.00 | Bad | Comparative Example |
| 39 | 16 | 720 | 30 | 12.4 | 51 | 0.10 | 850 | 120 | 14.0 | 1575 | 6.00 | 8.40 | 9.66 | 9.50 | Fair | Example of Present Invention |
| 40 | 16 | 720 | 60 | 13.1 | 50 | 0.11 | 850 | 120 | 14.4 | 1590 | 6.00 | 8.40 | 9.66 | 9.50 | Fair | Example of Present Invention |
| 41 | 16 | 700 | 15 | 4.9 | 72 | 0.05 | 850 | 120 | 13.3 | 1530 | 5.80 | 8.12 | 9.34 | 9.00 | Fair | Example of Present Invention |
| 42 | 36 | 650 | 60 | 3.7 | 55 | 0.10 | 880 | 90 | 16.4 | 2170 | 5.90 | 8.26 | 9.50 | 9.00 | Bad | Comparative Example |
| 43 | 16 | 700 | 130 | 10.2 | 48 | 0.11 | 850 | 120 | 15.9 | 1580 | 5.90 | 8.26 | 9.50 | 9.00 | Bad | Comparative Example |

An underline represents that a condition is out of the range of the present invention, a manufacturing condition is not preferable, or properties are not preferable.

Referring to Tables 2A and 2B, it could be seen that in the hot-dip galvanized steel sheets according to the examples of the present invention, the tensile strength was 1500 to 2500 MPa, the cross-sectional area ratio of voids was reduced to 15.0 or less, and as a result, hot-stamp formed bodies having excellent spot weldability were obtained. Particularly, with regard to Manufacture Nos. 1 to 25, the cross-sectional area ratio of voids in the hot-stamp formed bodies was reduced to 13.0% or less and spot weldability was further improved.

The hot-dip galvanized steel sheets according to the examples of the present invention in Tables 2A and 2B contained, as residual structures other than unrecrystallized ferrite in the region between a depth of 50 μm from the surface of the steel sheet and a depth of 100 μm from the surface of the steel sheet, by area %, ferrite: 0% to 50%, bainite and martensite: 0% to 50%, pearlite: 0% to 50% and residual austenite: 0% to 5%. In addition, a metallographic structure of an inside the steel sheet included, by area %, the sum of unrecrystallized ferrite and ferrite: 0% to 100%, bainite and martensite: 0% to 100%, pearlite: 0% to 80%, and residual austenite: 0% to 5%.

On the other hand, it could be seen that in the hot-dip galvanized steel sheets according to the comparative examples in Table 2B, the tensile strength was outside the range of 1500 to 2500 MPa and/or the cross-sectional area ratio of voids exceeded 15.0%, so that hot-stamp formed bodies having insufficient spot weldability were obtained.

INDUSTRIAL APPLICABILITY

According to the aspect of the present invention, it is possible to provide a hot-dip galvanized steel sheet from which a hot-stamp formed body having excellent spot weldability and having strength generally required for a hot-stamp formed body can be obtained.

What is claimed is:

1. A hot-dip galvanized steel sheet comprising:

a steel sheet;

a boundary layer provided on the steel sheet; and a hot-dip galvanized layer provided on the boundary layer, wherein the steel sheet contains, as a chemical composition, by mass %, C: 0.18% to 0.50%,
Si: 0.10% to 1.50%,
Mn: 0.50% to 2.50%,
Al: 0.001% to 0.100%,
Ti: 0.010% to 0.100%,
S: 0.0100% or less,
P: 0.100% or less,
N: 0.0100% or less,
Nb: 0% to 0.05%,
V: 0% to 0.50%,
Cr: 0% to 0.50%,
Mo: 0% to 0.50%,
B: 0% to 0.0100%,
Ni: 0% to 2.00%,
a sum of REM, Ca, Co, and Mg: 0% to 0.0300%, and
a remainder comprising Fe and impurities, in a region between a surface of the steel sheet and a depth of 25 μm from the surface of the steel sheet, an average grain size exceeds 4.0 μm, in a region between a depth of 50 μm from the surface of the steel sheet and a depth of 100 μm from the surface of the steel sheet, an area ratio of unrecrystallized ferrite is 50% or more, and in the hot-dip galvanized layer, a maximum value of a C concentration is 0.05 mass % or more.

2. The hot-dip galvanized steel sheet according to claim 1, wherein the steel sheet contains, as the chemical composition, by mass %, one or more of Nb: 0.02% to 0.05%,
V: 0.005% to 0.50%,
Cr: 0.10% to 0.50%,
Mo: 0.005% to 0.50%,
B: 0.0001% to 0.0100%,
Ni: 0.01% to 2.00%, and
a sum of REM, Ca, Co, and Mg: 0.0003% to 0.0300%.

3. The hot-dip galvanized steel sheet according to claim 1, wherein the steel sheet contains, as the chemical composition, by mass %, C: 0.25% to 0.50%.

4. The hot-dip galvanized steel sheet according to claim 2, wherein the steel sheet contains, as the chemical composition, by mass %, C: 0.25% to 0.50%.

* * * * *